US008803760B2

(12) United States Patent
Chakam et al.

(10) Patent No.: US 8,803,760 B2
(45) Date of Patent: Aug. 12, 2014

(54) MULTI-PART ANTENNA HAVING A CIRCULAR POLARIZATION

(75) Inventors: Guy-Aymar Chakam, Regensburg (DE); Martin Weinberger, München (DE)

(73) Assignee: Continental Automotive GmbH, Hannover (DE)

( * ) Notice: Subject to any disclaimer, the term of this patent is extended or adjusted under 35 U.S.C. 154(b) by 800 days.

(21) Appl. No.: 12/809,708

(22) PCT Filed: Dec. 1, 2008

(86) PCT No.: PCT/EP2008/066498

§ 371 (c)(1), (2), (4) Date: Jun. 21, 2010

(87) PCT Pub. No.: WO2009/077312

PCT Pub. Date: Jun. 25, 2009

(65) Prior Publication Data

US 2010/0277376 A1 Nov. 4, 2010

(30) Foreign Application Priority Data

Dec. 19, 2007 (DE) ..... 10 2007 061 305

(51) Int. Cl.

| | |
|---|---|
| ***H01Q 1/36*** | (2006.01) |
| ***H01Q 9/04*** | (2006.01) |
| ***H01Q 9/42*** | (2006.01) |
| ***H01Q 1/24*** | (2006.01) |

(52) U.S. Cl.

CPC ..... *H01Q 9/0421* (2013.01); *H01Q 9/42* (2013.01); *H01Q 1/243* (2013.01); *H01Q 1/36* (2013.01)

USPC ..... 343/895; 343/741

(58) Field of Classification Search

CPC ..... H01Q 1/243; H01Q 1/36; H01Q 9/42

USPC ..... 343/700 MS, 702, 741, 796, 803, 895, 343/742, 743

See application file for complete search history.

(56) References Cited

U.S. PATENT DOCUMENTS

| | | | | |
|---|---|---|---|---|
| 5,136,303 | A * | 8/1992 | Cho et al. | 343/718 |
| 6,906,667 | B1 * | 6/2005 | Poilasne et al. | 343/700 MS |
| 6,943,730 | B2 * | 9/2005 | Poilasne et al. | 343/700 MS |
| 2004/0080458 | A1 * | 4/2004 | Sekine et al. | 343/702 |
| 2005/0052656 | A1 | 3/2005 | Lindner et al. | |
| 2007/0285335 | A1 | 12/2007 | Bungo et al. | |

FOREIGN PATENT DOCUMENTS

| | | | |
|---|---|---|---|
| EP | 1703586 | A1 | 9/2006 |
| WO | 03044892 | A1 | 5/2003 |

* cited by examiner

*Primary Examiner* — Robert Karacsony

(74) *Attorney, Agent, or Firm* — Laurence A. Greenberg; Werner H. Stemer; Ralph E. Locher

(57) ABSTRACT

An antenna device has a first antenna branch and a second antenna branch. Both the first and the second antenna branches have the shape of a non-closed conductor loop and are connected to each other to form a cohesive conductor loop. The respective loop ends are disposed parallel to each other at a distance directed perpendicular (z axis) to the course of the loop. The antenna device has two connections that are disposed in the center section of the cohesive conductor loop at a distance from each other.

20 Claims, 6 Drawing Sheets

MULTI-PART ANTENNA HAVING A CIRCULAR POLARIZATION

BACKGROUND OF THE INVENTION

Field of the Invention

The invention relates to a device for transmitting and receiving electromagnetic waves and relates, in particular, to an antenna array having a circular polarization.

Radio-based access systems have now become standard for controlled access to motor vehicles. Said access systems are primarily used for easy unlocking and closing of the vehicle doors and trunk, as well as activating and deactivating an engine immobilizer present in the vehicle.

By integrating bi-directional communication into the radio transmission between the mobile radio station of the access system and the remote station formed as an on-board station in the vehicle, further radio services, such as for example remote control and remote request functions may be implemented. Thus it is possible to retrieve data relating to the status of the vehicle by means of the mobile station. For example, this includes information about the filling level of the fuel tank, the tire pressure, a possible alarm state, the engine temperature or the like. Moreover, the bi-directional communication generally also provides the possibility of accessing further functions of the vehicle so that, for example, vehicle windows, sun roofs and sliding doors, but also a heating system which is possibly present in the vehicle, may be operated from a greater distance.

For the radio connection between the mobile station and the on-board station of the access system, a plurality of frequency ranges are available which are predominantly in the ISM band (Industrial, Scientific and Medical band). The frequency ranges which may be used for the bi-directional communication are in the range of a few megahertz (MHz) up to several Gigahertz (GHz). These frequency bands are, however, not identical in all countries, so that the radio stations generally have to be optimized for a plurality of frequency bands.

The services supported by the radio-based access systems require an operating range of a few meters (for example for unlocking the vehicle doors), through a few hundred meters, up to the kilometer range for some remote requests. Specific services, such as for example opening of the vehicle doors, may thus occasionally only be activated when coming within a specific distance of the vehicle. Other requests, such as for example the request for the current parking time, should be able to be carried out over distances which are as large as possible. The propagation characteristics for the radio waves between the two stations of the access system are thus characterized by different parameters. Apart from the frequency range, these are primarily the distance between the radio stations, the polarization direction of the electromagnetic wave used for radio transmission, the type of antenna and/or antennae attached in or on the vehicle, the type of antenna and/or antennae used in the mobile station, the spatial orientation of the mobile radio station and the position thereof in the hand or on the body of the user and finally also the environment in the region of the radio connection path, which determines the propagation characteristics.

The antenna and/or antennae of the radio station located in the vehicle is and/or are generally designed so that for the transmitted and received signals, a specific polarization of the radio wave is preferred. Generally, this is vertical polarization, i.e. the polarization direction in which the E-vector is vertically aligned. This is required by the shortened vertical monopole antenna which is predominantly used in vehicles.

Loop antennae or monopole antennae, as well as combinations of both types of antennae, are generally used in mobile radio stations. In the case of monopole antennae, helical antennae are predominantly preferred.

Loop antennae are characterized by their low hand sensitivity, but generally are less efficient and produce a purely horizontal polarization.

The efficiency of monopole antennae is generally greater but, due to the smaller ground counterpoise, the power transmitted via the antenna is very sensitive to contact (hand sensitivity) and to influences from the remaining immediate environment of the radio device. Also, this type of antenna only supports one polarization direction and, moreover, also has an additional zero point in the direction of the longitudinal axis of the device in the directional diagram. In mobile radio devices with a smaller operating range, monopole antennae have hitherto been used which are directly printed onto the printed circuit board of the device. In this case, the hand sensitivity is even greater since, when using the device, generally the entire antenna is covered by the hand.

Antenna arrays constructed from a combination of loop antennae and monopole antennae do allow a compromise to be made but, depending on the contact, the characteristic of one or other type of antenna predominates. In practice, the two antennae are arranged in parallel, whereby tuning of one of the two antennae always has an effect on the radiation characteristic and/or receiving characteristic of the respective other antenna. The radiation and reception of electromagnetic waves even in this combination of antennae is also substantially linearly polarized.

For antennae with a high degree of efficiency, structures with monopole or dipole characteristics are considered, amongst others. Loop structures with conductor dimensions acceptable for mobile radio stations generally have losses which are too great in order to be suitable for the required operating ranges.

In all the types of antenna described above, and possible combinations thereof, regions are always present in the directional diagram in which no connection and/or only an inadequate connection is possible. Apart from the hand sensitivity and the so-called zero points in the directional diagram, in this connection the linear polarization is predominantly a problem. As it is generally the user who decides how the mobile radio station is held in the hand, it is not possible for the manufacturer to match the relative polarization directions of the mobile station and on-board station to one another. Instead, it is assumed that the polarization directions of both stations may be oriented, if required, in any manner relative to one another. Depending on the polarization direction, therefore, quite different transmission conditions may prevail with the same distances between the mobile radio station and the vehicle. In an extreme case, the polarization directions of the mobile station and the on-board station may be perpendicular to one another, whereby instead of generally sufficient transmission power, no communication is achieved even with relatively small distances.

By using an antenna structure with circularly polarized radiation, corresponding faulty alignments of the polarization directions may be avoided. In order to achieve a circularly polarized radiation with conductor dimensions acceptable for mobile radio stations, a folded dipole structure with two antenna branches may be used which are configured in the form of two winding elements oriented in opposing directions and arranged on top of one another. If the HF feed line is located between the two antenna branches, then the current directions run parallel to one another in the antenna branches, whereby in combination with the loop shape of the antenna branch an H-field is produced. Due to the potential difference between the two antenna branches arranged on top of one another, an E-field is produced which is aligned parallel with the H-field. As this alignment of the fields is also provided in the far field, the E-vector produced from the H-field is located perpendicular to that produced from the E-field, from which a circular polarization is produced. Such antenna structures, however, require a matching network for matching the input impedance to the output impedance of the HF feed line. The radiation power of such structures is limited by the complex matching circuit of the HF feed line.

BRIEF SUMMARY OF THE INVENTION

It is, therefore, the object of the present invention to provide an antenna structure having a circularly polarized radiation characteristic and receiving characteristic with high radiation power and easy adaptability.

The object is achieved according to the independent claims of the invention.

The invention comprises an antenna device comprising a first antenna branch and a second antenna branch, both the first and the second antenna branch having the form of a non-closed conductor loop and being connected to one another so that they form a cohesive conductor loop and the antenna branches are arranged spaced apart from one another in a direction which runs substantially perpendicular to the surface enclosed by the respective conductor loop, and the antenna device comprising at least two feed points which are arranged in the center section of the cohesive conductor loop at a distance from each other.

The invention further comprises a radio station which comprises such an antenna device and an HF feed line, which is connected via the two feed points electrically or via an HF coupler to the antenna device.

In this connection, reference is made to the fact that the terms "comprise", "have", "contain", "include" and "with", as well as the grammatical variants thereof used in this description and the claims for listing the features, are generally to be understood as an inconclusive list of features, such as for example method steps, devices, areas, sizes and the like, which by no means excludes the presence of other or additional features or groups of other or additional features.

A corresponding antenna device represents a resonator structure activated by the HF feed line, the antenna currents thereof being a multiple of the feed current to be activated and producing high transmitting field strengths. The particular geometry of the antenna branches produces a circularly polarized far field, which in connection with the high radiation power permits a reliable radio connection even over long distances, irrespective of the alignment with a radio counter station. Due to the small and/or intrinsic ground counterpoise, the antenna structure has low hand sensitivity. The input impedance of the array may be freely selected by the choice of feed points, so that a matching network for matching the impedance to the HF feed line is not necessarily required. Due to the compact design of the antenna branches in the shape of the conductor loop, the antenna device is suitable, in particular, for use in small mobile radio devices, such as for example in vehicle locks, the device dimensions thereof falling below a quarter of the wave length used for transmission.

The invention is developed in the dependent claims thereof.

For a simple HF feed line the at least two feed points are in each case advantageously designed in the form of a connector or as part of an HF coupler.

Preferably, the shape of the first antenna branch substantially corresponds to the shape of the second antenna branch, whereby a defined configuration of the E-field may be achieved.

The first antenna branch may be arranged relative to the second antenna branch such that the position of the first antenna branch substantially results from a 180° rotation of the second antenna branch about an axis of symmetry. As a result of this symmetry of the array, the E-field is configured perpendicular to the conductor loop parts, so that it is aligned parallel to the antenna current flowing through the conductor loop.

A compact antenna structure is achieved by the first and the second antenna branch together defining a parallelepiped hollow space, the parallelepiped hollow space, in particular, also being able to be configured as cuboidal. For an advantageous reduction in size of the antenna structure, the conductor structure may be configured so that the loop ends of the first and the second antenna branch in each case protrude into one of the defining surfaces of the hollow space.

Alternatively, a compact antenna structure may also be achieved if the first and the second antenna branch together define a cylindrical hollow space, the first and the second antenna branch preferably together defining a hollow space in the shape of a half-pipe.

Expediently, the spacing between the first antenna branch and the second antenna branch is substantially constant. If required, the spacing between the first antenna branch and the second antenna branch may vary in the direction of the loop, whereby an optimization may be undertaken when matching the antenna geometry to a predetermined housing geometry.

In an advantageous development, the spacing between the two connectors is selected so that the impedance between the two connectors in the region of the supplied frequency band corresponds to the source impedance of the HF feed line. As a result, matching networks are superfluous and thus the manufacturing costs are reduced.

Further features of the invention are revealed from the following description of exemplary embodiments according to the invention in combination with the claims and the figures. The individual features may be implemented separately or in combination in an embodiment according to the invention. In the following description of several exemplary embodiments of the invention, reference is made to the accompanying figures, in which:

DESCRIPTION OF THE INVENTION

Figure 1:
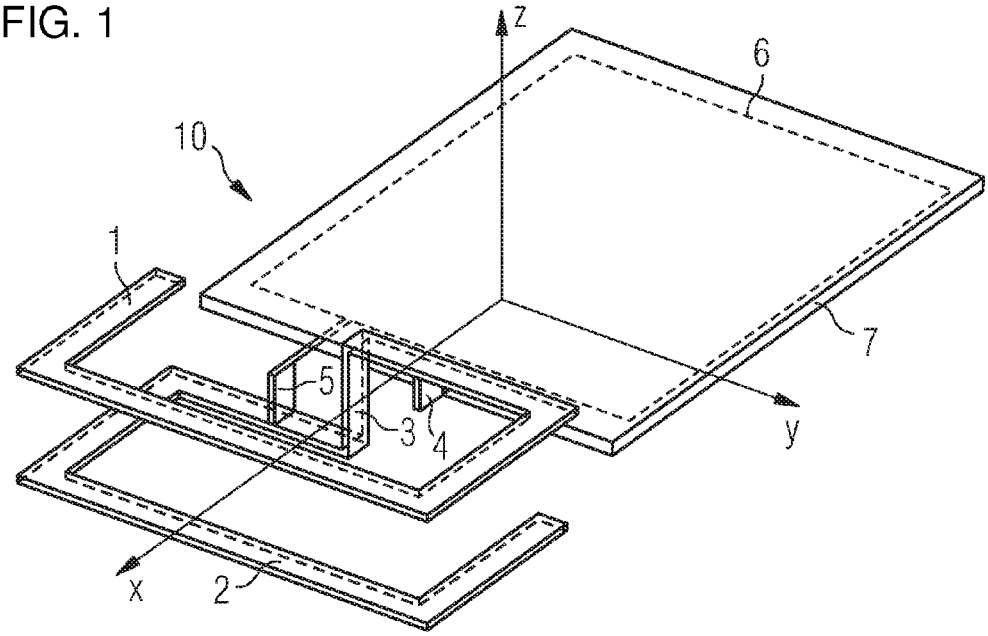
FIG. 1 shows a first exemplary embodiment of an antenna device for producing a circularly polarized electromagnetic wave with a high degree of efficiency.

In FIG. 1 a first exemplary embodiment of an antenna device 10 for producing a circularly polarized far field is shown. The device has two emitter elements 1 and 2 connected via a web connection 3, which are denoted hereinafter as the first antenna branch 1 and the second antenna branch 2. The HF feed line 8 (not shown in FIG. 1) is connected (see FIG. 2) via the first connector 4 to the first antenna branch 1 and via the connector 5 to the second antenna branch 2. One of the two connectors, connector 5 in the example shown, is additionally connected to the ground plane 6 of the circuit carrier 7. Apart from producing the connections to the HF feed line, the connectors 4 and 5 are also used in the example shown to hold the antenna structure defined by the web connection 3 and the antenna branches 1 and 2 in a relative position to the circuit carrier 7. The antenna branches may be arranged symmetrically (the plane of the circuit carrier is located level with the middle of the web connection) or asymmetrically to the circuit carrier.

Each of the two antenna branches shown in FIG. 1 may be regarded as a three-quarter winding, the winding direction of the antenna branch 1 being continued according to the web connection 3 of the antenna branch 2. In principle, therefore, each of the two antenna branches 1 and 2 forms a non-closed conductor loop. The antenna branch 1 is arranged above the antenna branch 2 so that in plan view (viewing direction parallel to the z-axis) due to the winding, which is now in total a one-and-a-half winding, an ostensibly closed loop structure is produced. Naturally, the antenna branch 1 may also be arranged below the antenna branch 2. In this case, a reverse winding direction is obtained.

In the embodiment shown, the "closed" loop structure defines a rectangular surface. If the two antenna branches 1 and 2 as shown in FIG. 1 (in the z-direction) are arranged vertically above one another, the conductor loops formed from the two antennae define a cuboidal hollow space. If the two antenna branches 1 and 2 (in the z-direction), however, are arranged obliquely offset above one another, this hollow space has the shape of an oblique parallelepiped.

Figure 2:
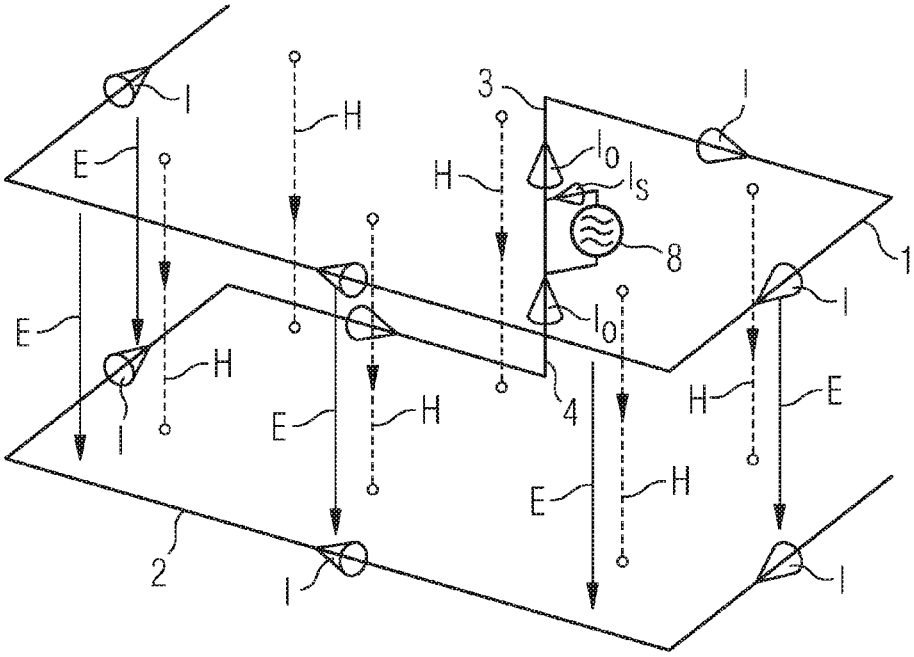
FIG. 2 illustrates the current directions of the antenna device of FIG. 1 and the fields produced, as a result, in the near field.

In FIG. 2 are illustrated the current distributions on the conductor structures of the antenna device of FIG. 1, fragmented and schematized, and the fields produced thereby. The first conductor structure of the antenna device is formed by the first antenna branch 1 from the connector 4, the second conductor structure of the second antenna branch 2 from the connector 5. The antenna array is fed by the HF feed line 8 which is connected via the connectors 4 and 5 to the conductor structure acting as an antenna. The HF feed line is connected in terms of circuit design parallel to the web connection 3. In combination with the portions of the respective antenna branches, including the connectors 4 and 5, the web connection 3 acts as impedance matched to the HF feed line. The matching to the source impedance (generally in the range of 50 to 200 Ohms), therefore, takes place in the structure shown directly over the length of this portion and/or the length of the feed lines.

The direction of current on the conductor structures is indicated by arrowheads. The direction of current provided is only valid for one of the two half-waves of the guided wave. In the other half-wave, the direction of current and thus also the directions of the electrical and magnetic fields produced are reversed. The physical relationships are, however, the same for both half-waves.

The feed current $I_s$ generated by the HF feed line 8 is introduced into the conductor structure formed by the antenna branches 1 and 2 together with the web connection 3 via the two connectors 4 and 5. As a result of the current flow, the two antenna branches 1 and 2 adopt an opposing polarity. The antenna current I has different amplitude values along the conductor structure. As the web connection 3 combines the two antenna branches 1 and 2 to form a continuous winding, the antenna current I runs in the upper antenna branch 1 in the same direction parallel to the antenna current in the lower antenna branch 2. Thus the magnetic fields produced by the current flows in the two antenna branches are added together in phase, so that the path of the H-field inside the hollow space enclosed by the conductor loops, in a first approximation, has the directional path illustrated in FIG. 2. The different polarity of the two antenna branches 1 and 2 leads to the formation of an electrical field E, the field lines thereof being indicated in FIG. 2. Thus the two fields produced via the antenna current I, i.e. the electrical E-field and the magnetic H-field, in the region of the hollow space enclosed by the conductor loops 1 and 2, are arranged substantially parallel to one another. This parallel alignment of the two field components is also provided in the far field of the antenna array, so that the resulting E-vectors are located perpendicular to one another. Their phases, therefore, differ by $\pi/2$.

As a result, therefore, the antenna structure shown in FIG. 1 produces a circularly polarized wave which may be received by a linearly polarized antenna structure with low losses and which is spatially oriented in any manner. The antenna device 10 of FIG. 1 thus ensures a matching of the polarization of the signal transmission, since an orthogonal alignment of the polarization directions of the radio wave and receiver antenna is generally excluded.

In contrast to dipole antennae, in which the antenna current flows through the HF feed line and/or the matching network, which connect the two antenna branches in series, the HF feed line in the antenna array shown in FIG. 1 is arranged in parallel with the central segment of the antenna branches 1 and 2 connected to the web connection 3. As a result, the antenna current I may flow unhindered in the conductor structure. The conductor structure formed by the web connection 3 and the two antenna branches 1 and 2 corresponds to a resonator, which is activated via the coupled HF feed line. As a result of the resonance conditions, therefore, the antenna current I may be a multiple of the feed current I. With an electrical length of the resonator (which corresponds to the length of the conductor structure) of $\lambda/2$, in practice antenna currents are attained, for example, which may be ten times the feed current $I_S$ or more.

Figure 3A:
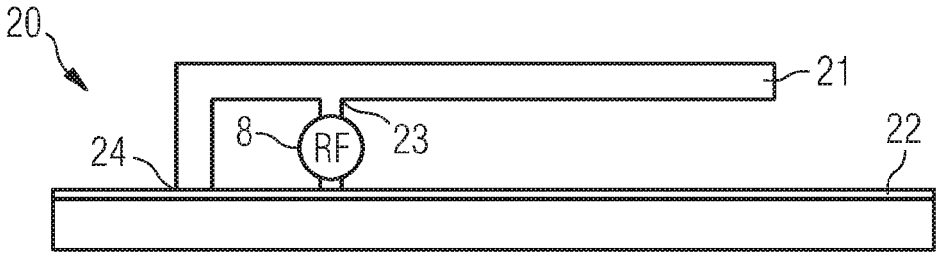
FIG. 3 shows the basic structures of an inverted F-antenna (IFA), a double-IFA and a double-IFA with rotated symmetry.
Figure 3B:
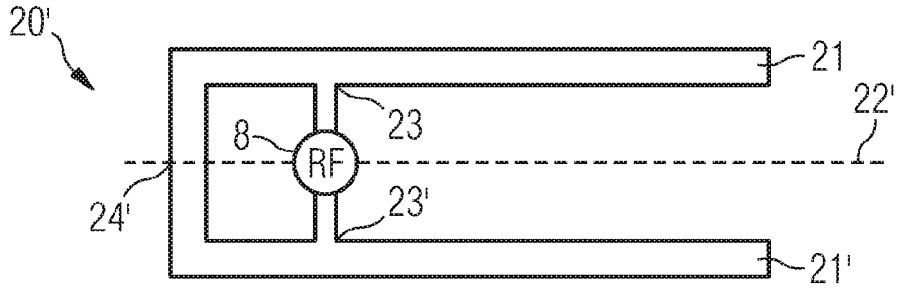
Figure 3C:
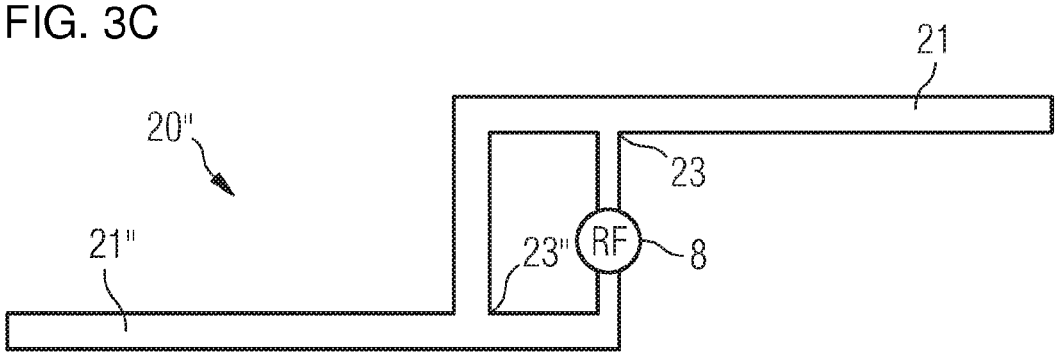

The antenna structure shown in FIG. 1 represents a double-IFA (IFA=inverted F-antenna) with rotated symmetry. In an IFA 20 as illustrated in FIG. 3*a*, an L-shaped emitter element 21 is arranged above a ground plane 22. The emitter element is connected by its short branch to the ground contact 24 of the ground plane 22. The feed current is coupled via a feed point 23 arranged on the long branch of the emitter element 21. The HF feed line 8 is arranged between the feed point 23 and the ground plane. If two symmetrically constructed emitters 21 and 21' as shown in FIG. 3*b* are connected to one another to form a double-IFA 20', the feed current produced by the HF feed line 8 is coupled via the two feed points 23 and 23'. As a result of symmetry, the ground plane 22 with the ground contact 24 is replaced by a virtual ground plane with a virtual ground contact 24', whereby the hand sensitivity of the antenna 20' is markedly reduced. If the L-shaped emitter elements 21 and 21" are arranged rotated by 180° relative to one another, the double-IFA 20" shown in FIG. 3*c* is obtained with rotated symmetry, and which has the feed points 23 and 23". The antenna structure of FIG. 1 is derived from this structure, the emitter elements thereof being configured such that an H-field is produced parallel to the E-field.

Figure 4:
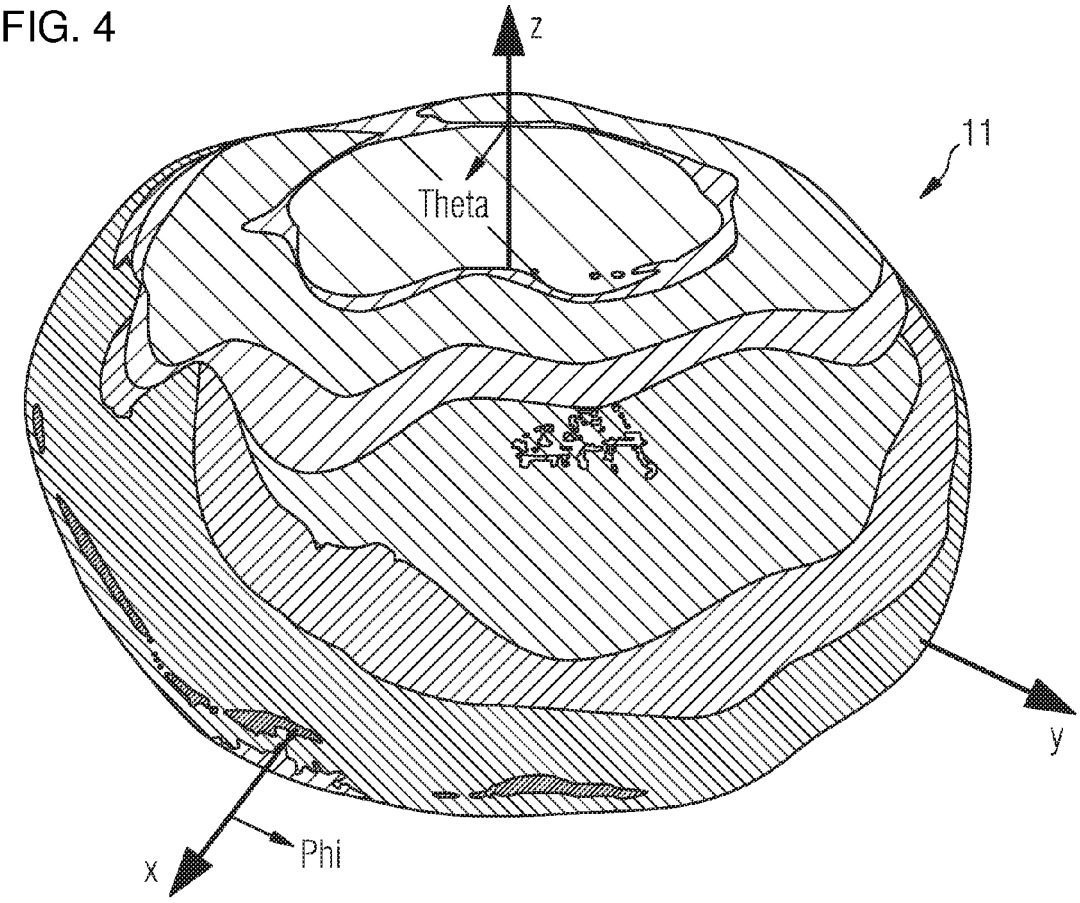
FIG. 4 shows the radiation characteristic of the antenna device of FIG. 1.

The radiation characteristic and/or the total gain 11 of the antenna structure 10 of FIG. 1 is reproduced in FIG. 4. An approximately isotropic distribution of the total gain is shown, similar to that of a loop antenna and/or that of a shortened dipole. The difference between the maximum (shown in dark shading) and the minimum (shown in light shading) is only a few dB in large areas.

Figure 5:
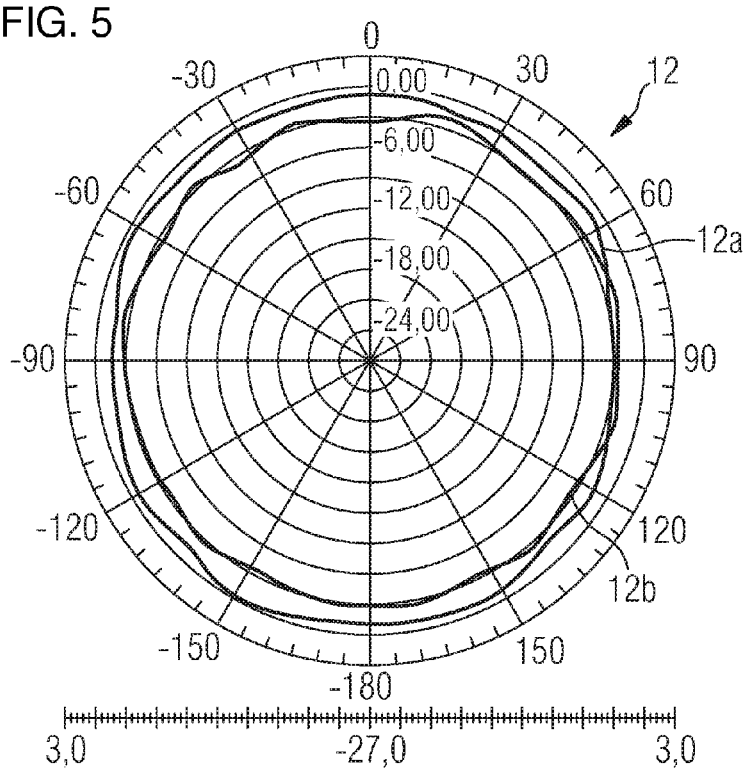
FIG. 5 shows the diagram in the x-y plane of the antenna of FIG. 1.

FIG. 5 shows a diagram in the x-y plane 12 calculated for the antenna device 10 of FIG. 1, in which the directional dependencies of the gain for the horizontal polarization (12*a*) and for the vertical polarization (12*b*) are shown. Both curves show a relatively uniform distribution. The amplitudes of the two orthogonal field components are thus almost identical, whereby an almost ideal circularly polarized radiation characteristic is achieved.

Figure 6:
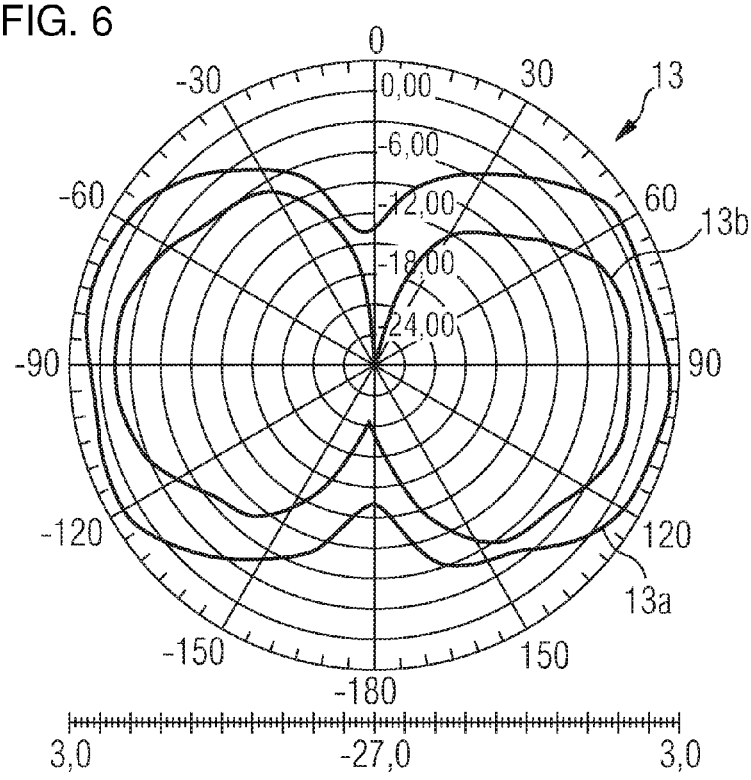
FIG. 6 shows the diagram in the x-z plane of the antenna of FIG. 1.

The directional dependencies of both wave emissions in the x-z plane are shown in FIG. 6. The diagram 13*a* (horizontal polarization) shows, as in the diagram 13*b*, (vertical polarization) a markedly cardioid characteristic, the maximum radiation power being provided at an angle of approximately ninety degrees rotationally symmetrically about the z-axis.

Figure 7:
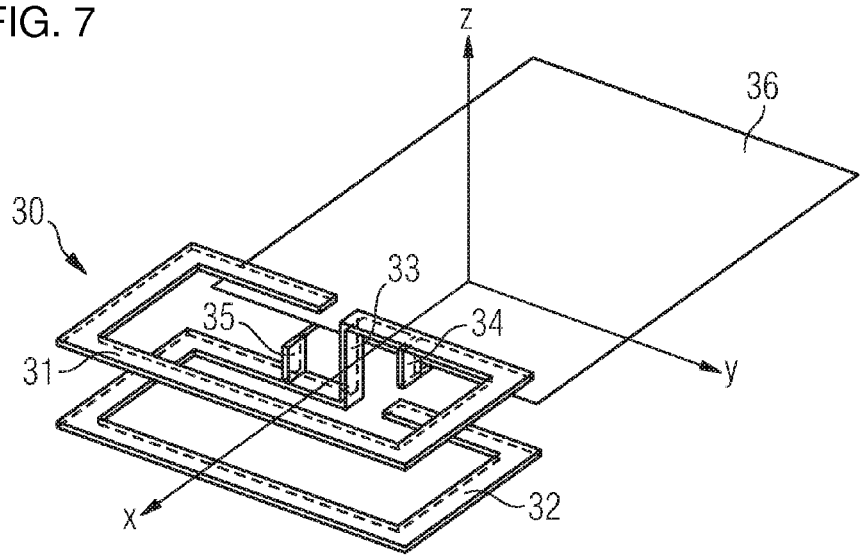
FIG. 7 shows a second exemplary embodiment of an antenna device for producing a circularly polarized electromagnetic wave with high field strengths.

In FIG. 7, a second exemplary embodiment is shown for an antenna device 30 for producing a circularly polarized far field. In contrast to the first embodiment 10 of FIG. 1, each of the two antenna branches 31 and 32 are not only designed as a three-quarter winding but as a winding which is almost, but not entirely, complete. The HF signals are supplied as in the first exemplary embodiment via the connectors 34 and 35, one of the two connectors being able to be connected to the ground 36 of an electronic circuit. The design of the antenna branches 31 and 32 with a further segment and/or a further folding at the free end makes a more compact, i.e. narrower design of the antenna array 30, possible, as the overall length of the conductor structure formed by the two antenna branches 31 and 32 together with the web connection 33, does not change relative to the first exemplary embodiment.

Figure 8:
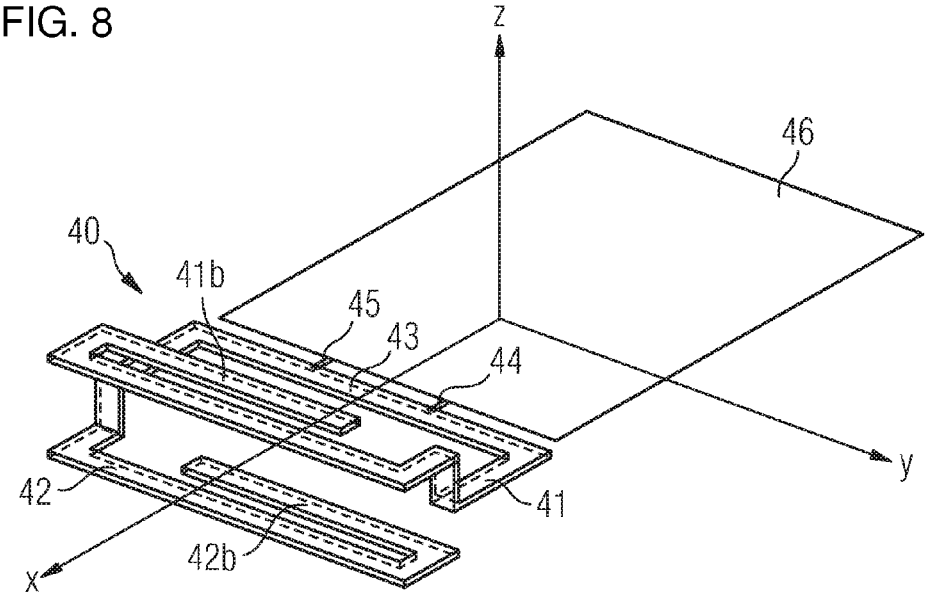
FIG. 8 shows a third exemplary embodiment of an antenna device for producing a circularly polarized electromagnetic wave with high field strengths.

A further embodiment with a modified shape of the antenna branches relative to FIG. 1 is illustrated in FIG. 8. In contrast to the antenna branches 1 and 2, the free ends 41*b* and 42*b* of the antenna branches 41 and/or 42 are folded back so that the last conductor portion 41*b* and/or 42*b* of an antenna branch is arranged parallel and in the vicinity of the previous conductor portion 41*a* and/or 42*a*. As a result, the ends of the antenna paths, which react very sensitively to capacitive effects, are positioned further away from interfering housing parts or the hand of the user. As the current strengths on the antenna branches are distributed unevenly so that they have the greatest amplitudes in the center of the antenna branches but at the ends thereof they are practically zero, the region around the free end of an antenna branch contributes only very little to the formation of the H-field. The folding back of the ends of the antenna branches shown permits, therefore, a length of the antenna branches corresponding to the respectively required resonance in a reduced space, without at the same time influencing negatively the radiation characteristic and radiation power of the antenna array too greatly. Moreover, it may be derived from FIG. 8 that the vertical spacing between the two antenna branches 41 and 42 is only required in the regions in which said antenna branches have to be arranged on top of one another to produce the E-field, i.e. in the regions with the greatest potential differences. The region in the vicinity of the web connection is located together with the connectors 44 and 45 in one plane.

Figure 9:
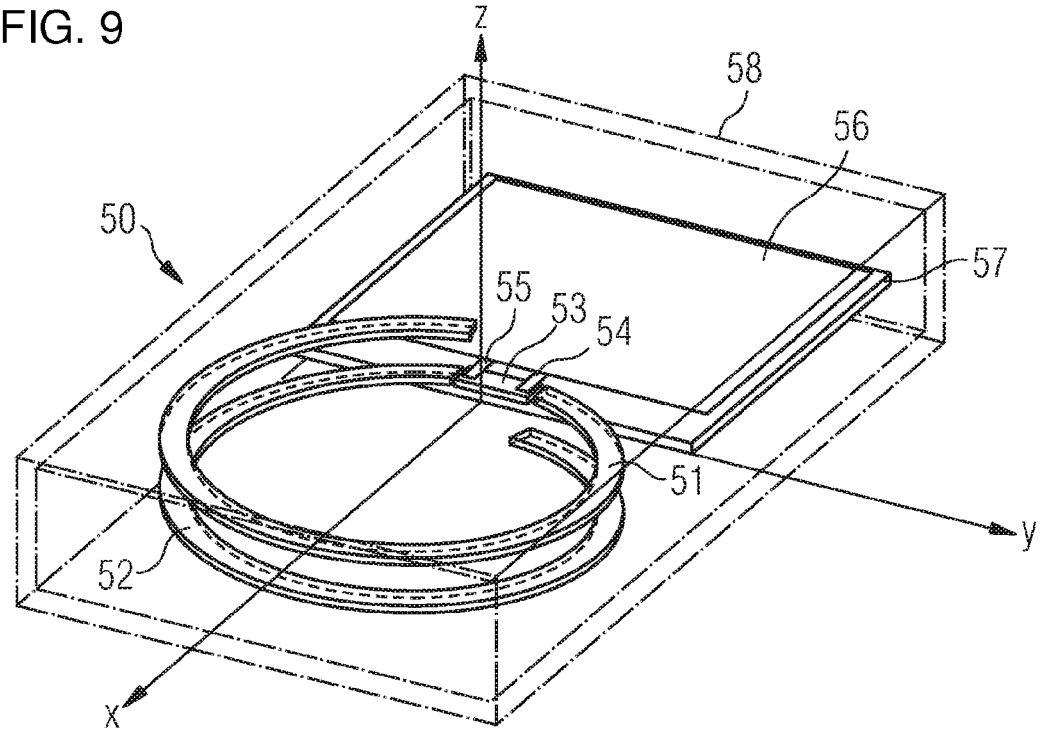
FIG. 9 shows a fourth exemplary embodiment of an antenna device for producing a circularly polarized electromagnetic wave with high field strengths.

FIG. 9 shows a further alternative embodiment 50 of an antenna array formed as a double-IFA for producing a circularly polarized electromagnetic wave. In contrast to the previous embodiments 10, 30 and 40, the two antenna branches 51 and 52 in this case are of annular configuration. The two antenna branches 41 and 42 thus define a substantially cylindrical hollow space. Both are adjacent to the web connection 53, which together with the connectors 54 and 55 are arranged in the plane of a circuit carrier 57 designed, for example, as a printed circuit board. One of the connectors is preferably connected to the ground 56 formed on the printed circuit board. The two antenna branches 51 and 52 have a helical structure, the winding direction extending from the connector on the web connection to the free end of the antenna branches in opposing directions to one another. Due to the helical design, the spacing between the two antenna branches 51 and 52 is uniform. The contours 58 illustrate a housing geometry for accommodating the antenna array 50 and the corresponding wiring on the printed circuit board 57.

Figure 10:
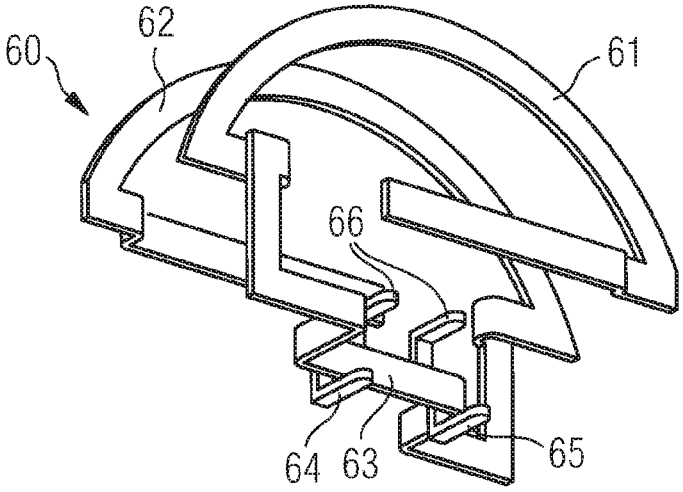
FIG. 10 shows a fifth exemplary embodiment of an antenna device for producing a circularly polarized electromagnetic wave with high field strengths.

In FIG. 10, a further embodiment of a double-IFA antenna array 60 configured as a resonance structure is shown, which illustrates that the winding and/or loop geometry of the antenna branches 61 and 62 may be adapted to a large extent to a predetermined housing shape. The small stepped and/or step-shaped folds and the design of the two antenna branches 61 and 62 enclosing a hollow space in the shape of a half-pipe, serve for adapting to a housing with a conically rounded shape. In addition to the two connectors 64 and 65 on the web connection 63, the structure also comprises fastening clips 66, which are not used for electrical contacts but merely for the mechanical fastening of the conductor structure to a circuit carrier.

Even if the invention has been described hitherto with reference to specific types of antenna branches, it is obvious for a person skilled in the art that shapes of the antenna branches deviating therefrom may also be used with the same or a similar result. In particular, the arrangement of the antenna structure shown in the exemplary embodiments of FIGS. 1, 7, 8, 9 and 10, in which the E-field and H-field produced are aligned perpendicular to the main surfaces of the circuit carrier 7, is not required. For adapting to specific predetermined housings, the antenna array may be arranged in any orientation to the circuit carrier 7. In the same manner, also the arrangement of the feed geometry may be arranged differently from that in the exemplary embodiments set forth above. For example, the adaptation to different designs is simplified with feed geometries rotated by a specific angle.

In the examples set forth above, the loop length of an antenna branch was less than a complete winding. In an alternative embodiment, an antenna branch may also have the shape of a conductor loop with a plurality of windings. The possible shapes of the cross-sectional geometries of the windings are only limited by an H-field which is substantially parallel to the E-field being produced via the current flow through the two antenna branches. Thus a completely circular polarization does not have to be achieved, as the antenna structure even operates satisfactorily if the field strengths of the two polarization components differ from one another by a few dB. If antenna branches with a plurality of windings are used, said windings may be arranged both adjacent to one another for forming the resonator system, and interwoven with one another similar to a double helix.

Moreover, the spacing between the antenna branches does not have to be constant. Instead, in order to adapt the antenna structure to the available space, for example, the spacing profile may have almost any path. Also, the two antenna branches do not necessarily have to be designed symmetrically. Instead, by suitable dimensioning the structure may also deviate from a symmetrical design, a radiation characteristic similar to the symmetrical arrangement being able to be achieved.

The HF power is coupled in the above described exemplary embodiments by means of metal connectors. Alternatively, the HF feed line may, however, also be coupled via HF couplers, which similar to a directional coupler do not have to have galvanic contact with the antenna structure. Naturally, in this case the connection of the two antenna branches may also be designed such that it is of low impedance at the high frequency used.

The antenna array may be fastened and stabilized in very different ways. For example, support and/or fastening elements may be provided on the antenna branches themselves and/or on the connection web, which are designed and/or arranged such that they are almost at zero current during use of the antenna, and thus exert practically no negative influence on the current distribution of the emitting structure. For example, the ability to mount the antenna on a circuit carrier or within a housing may be improved if the ends of the antenna branches are folded back in the opposing direction to form a support. A further possibility for simplifying the mounting and for stabilizing the antenna structure is provided by the attachment of the antenna structure to a carrier, for example to a plastics carrier formed as a support structure. The antenna may thus, amongst others, be printed as an electrically conductive coating, applied by means of metallized films, or be produced by the structuring of PCB-metallizing.

An antenna array according to the invention may also be produced as a stamped-bent part or as a combination of a plurality of different components, for example a printed structure or the like continued with wire elements or housing parts.

It is essential that the geometry of the antenna structure is suitable for producing an H-field which is substantially parallel with the E-field, and the two antenna branches are connected to one another with low impedance at the frequency used, so that an externally-activated resonator system is formed. The disclosed antenna arrays are primarily suitable for use in mobile radio stations of, for example, vehicle access systems with a bi-directional communication interface.

LIST OF REFERENCE NUMERALS

1 First antenna branch according to the first embodiment
2 Second antenna branch according to the first embodiment
3 Web connection according to the first embodiment
4 Connector on the first antenna branch according to the first embodiment
5 Connector on the second antenna branch according to the first embodiment
6 Ground plane
7 Circuit carrier/printed circuit board
8 HF-feed line
10 Antenna device according to the first embodiment
11 Radiation characteristic of the antenna array according to the first embodiment
12 Horizontal diagram of the antenna array according to the first embodiment
**12*a*** Horizontal diagram of the H-field activated wave
**12*b*** Horizontal diagram of the E-field activated wave
13 Vertical diagram of the antenna array according to the first embodiment
**13*a*** Vertical diagram of the H-field activated wave
**13*b*** Vertical diagram of the E-field activated wave
20 IFA
20' Double-IFA
20" Double-IFA with rotated symmetry
21 L-shaped emitter element
21' L-shaped emitter element
21" L-shaped emitter element
23 Feed point
23' Second feed point with symmetrical double-IFA
23" Second feed point with double-IFA with rotated symmetry
24 Ground contact
24' Virtual ground contact
30 Antenna device according to the second embodiment
31 First antenna branch according to the second embodiment
32 Second antenna branch according to the second embodiment
33 Web connection according to the second embodiment
34 Connector on the first antenna branch according to the second embodiment
35 Connector on the second antenna branch according to the second embodiment
36 Ground plane of the second embodiment
40 Antenna device according to the third embodiment
41 First antenna branch according to the third embodiment
**41*b*** Folded-back free end of the first antenna branch according to the third embodiment
42 Second antenna branch according to the third embodiment
**42*b*** Folded-back free end of the second antenna branch according to the third embodiment
43 Web connection according to the third embodiment
44 Connector on the first antenna branch according to the third embodiment
45 Connector on the second antenna branch according to the third embodiment
46 Ground plane of the third embodiment
50 Antenna device according to the fourth embodiment
51 First antenna branch according to the fourth embodiment
52 Second antenna branch according to the fourth embodiment
53 Web connection according to the fourth embodiment
54 Connector on the first antenna branch according to the fourth embodiment
55 Connector on the second antenna branch according to the fourth embodiment
56 Ground plane of the fourth embodiment
57 Printed circuit board of the fourth embodiment
58 Housing for the fourth embodiment
60 Antenna device according to the fifth embodiment
61 First antenna branch according to the fifth embodiment
62 Second antenna branch according to the fifth embodiment
63 Web connection according to the fifth embodiment
64 Connector on the first antenna branch according to the fifth embodiment
65 Connector on the second antenna branch according to the fifth embodiment
66 Fastening means for antenna array according to the fifth embodiment

The invention claimed is:

1. An antenna device, comprising:

a first antenna branch formed as a non-closed conductor loop;

a second antenna branch formed as a non-closed conductor loop and connected to said first antenna branch such that said second antenna branch continues the conductor loop formed by said first antenna branch and continuing a winding direction thereof;

said second antenna branch being disposed at a spacing distance transversely to the winding direction of the conductor loop adjacent to said first antenna branch;

a first feed point disposed on said first antenna branch; and a second feed point disposed on said second antenna branch, said second feed point separated from said first feed point by a distance extending in the winding direction of the conductor low;

wherein an electrical length of a conductor loop formed by connecting said first antenna branch to said second antenna branch fulfills a resonance condition for an electromagnetic wave to be radiated;

wherein said first antenna branch and said second antenna branch form a double inverted F-antenna.

2. The antenna device according to claim 1, wherein each of said first and second feed points is formed as a connector terminal.

3. The antenna device according to claim 1, wherein said first and second feed points are configured as part of an HF coupler.

4. The antenna device according to claim 1, wherein a shape of said first antenna branch substantially corresponds to a shape of said second antenna branch.

5. The antenna device according to claim 1, wherein said first antenna branch is disposed relative to said second antenna branch such that a position of said first antenna branch substantially results from a 180° rotation of said second antenna branch about a given axis of symmetry.

6. The antenna device according to claim 1, wherein said first and second antenna branches together define a parallelepiped hollow space.

7. The antenna device according to claim 6, wherein said first and second antenna branches together define a cuboidal hollow space.

8. The antenna device according to claim 6, wherein a loop end of said first antenna branch and a loop end of said second antenna branch each protrudes into one of the defining surfaces of said hollow space.

9. The antenna device according to claim 1, wherein said first and second antenna branches together define a cylindrical hollow space.

10. The antenna device according to claim 9, wherein each of said first antenna branch and said second antenna branch has a helical configuration.

11. The antenna device according to claim 1, wherein said first and second antenna branches together define a hollow space having a shape of a half-pipe.

12. The antenna device according to claim 1, wherein a spacing between said first antenna branch and said second antenna branch is substantially constant.

13. The antenna device according to claim 1, wherein a spacing between said first antenna branch and said second antenna branch varies in a direction of the loop.

14. The antenna device according to claim 1, wherein said first and second antenna branches are disposed with a spacing distance from one another in a direction parallel to the winding direction and forming a closed loop in a plan view.

15. A radio station, comprising:

an antenna device according to claim 2; and an HF feed line electrically connected to said antenna device through said first and second feed points.

16. The radio station according to claim 15, wherein a spacing between said first and second connector terminal is selected such that an impedance between said connectors in a range of the supplied frequency band corresponds to a source impedance of said HF feed line.

17. A radio station, comprising:

an antenna device according to claim 3; and an HF feed line connected to said antenna device via an HF coupler.

18. The radio station according to claim 17, wherein a spacing between said first and second feed points is selected so that an impedance therebetween within a range of the supplied frequency band corresponds to a source impedance of said HF feed line.

19. The antenna device according to claim 1, further comprising a web connection connecting said first antenna branch and said second antenna branch together.

20. The antenna device according to claim 19, wherein said web connection is located between said first feed point and said second feed point.

* * * * *